US012691356B1

(12) United States Patent
Li

(10) Patent No.: US 12,691,356 B1
(45) Date of Patent: Jul. 28, 2026

(54) THROWING OBJECT COUNTING DEVICE

(71) Applicant: Shenzhen Jialexi Technology Co., Ltd., Shenzhen (CN)

(72) Inventor: Xiaowei Li, Jieyang (CN)

(73) Assignee: Shenzhen Jialexi Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/415,869

(22) Filed: Dec. 11, 2025

(30) Foreign Application Priority Data

Oct. 24, 2025 (CN) ..... 202522261752.X

(51) Int. Cl.
*A63B 71/06* (2006.01)

(52) U.S. Cl.
CPC ..... *A63B 71/0669* (2013.01)

(58) Field of Classification Search
CPC ... A63B 71/06; A63B 71/0686; A63B 71/669; A63B 67/06; A63B 67/066; A63B 63/08
See application file for complete search history.

(56) References Cited

U.S. PATENT DOCUMENTS 4,923,201 A * 5/1990 Nichol ..... A63F 9/02 273/127 R
8,162,318 B1 * 4/2012 Peterson ..... A63B 67/06 273/343
8,282,457 B1 * 10/2012 Edwards ..... A63B 67/002 273/342
9,314,680 B2 * 4/2016 Ali ..... A63F 9/24
D781,960 S * 3/2017 Czwalga ..... D21/303
10,226,676 B2 * 3/2019 Yip ..... A63B 63/08
11,648,453 B2 * 5/2023 Michael ..... A63B 67/06 273/372
11,904,225 B2 * 2/2024 Theobald ..... A63B 71/0622
12,364,917 B1 * 7/2025 Margareten ..... A63B 67/06
2010/0001471 A1 * 1/2010 Cho ..... A63B 63/003 273/348.4
2012/0013073 A1 * 1/2012 Wyland ..... A63B 67/066 273/287
2014/0151964 A1 * 6/2014 Alway ..... A63B 67/066 273/371
2017/0138586 A1 * 5/2017 Finch ..... F21V 33/008
2021/0308550 A1 * 10/2021 Li ..... A63B 71/0622
2022/0032157 A1 * 2/2022 Theobald ..... A63B 71/0622
2022/0096909 A1 * 3/2022 Russell ..... H05B 47/13

FOREIGN PATENT DOCUMENTS

WO WO-2011107293 A1 * 9/2011 ..... A63B 67/066

* cited by examiner

*Primary Examiner* — Brian P Wolcott

(57) ABSTRACT

A throwing object counting device includes a panel, at least one sensing module, and a counting module. The panel defines at least one receiving hole for a throwing object to pass through. The at least one sensing module is mounted in or close to the at least one receiving hole. The counting module is electrically connected to the sensing module.

16 Claims, 7 Drawing Sheets

THROWING OBJECT COUNTING DEVICE

CROSS REFERENCE TO RELATED APPLICATIONS

The present application claims priority of the Chinese patent application No. 202522261752.X, filed on Oct. 24, 2025, contents of which are incorporated herein by its entireties.

FIELD OF THE DISCLOSURE

The disclosure relates to the technical field of sports equipment, and in particular, to a throwing object counting device.

BACKGROUND

Existing throwing toys are usually equipped with receptacles. Throwing objects into the receptacles can exercise throwing skills or for play and competition.

For example, existing sandbag throwing toys are equipped with throwable sandbags and a panel, with a receiving hole formed on the panel for the sandbag to pass through. However, when users throw from a distance, it is difficult to determine whether the sandbag has passed through the receiving hole on the panel, or to count the number of times the sandbag has passed through the receiving hole.

SUMMARY

The following presents a simplified summary of the disclosure in order to provide a basic understanding of some aspects of the disclosure. This summary is not an extensive overview of the disclosure. It is not intended to identify critical elements or to delineate the scope of the disclosure. Its sole purpose is to present some concepts of the disclosure in a simplified form as a prelude to the more detailed description that is presented elsewhere.

In some embodiments, a throwing object counting device is provided. The throwing object counting device includes a panel, at least one sensing module, and a counting module. The panel defines at least one receiving hole for a throwing object to pass through. The at least one sensing module is mounted in or close to the at least one receiving hole. The counting module is electrically connected to the sensing module.

BRIEF DESCRIPTION OF THE DRAWINGS

Illustrative embodiments of the present disclosure are described in detail below with reference to the attached drawing figures.

NUMERAL REFERENCE IN THE DRAWINGS

Figure 1:
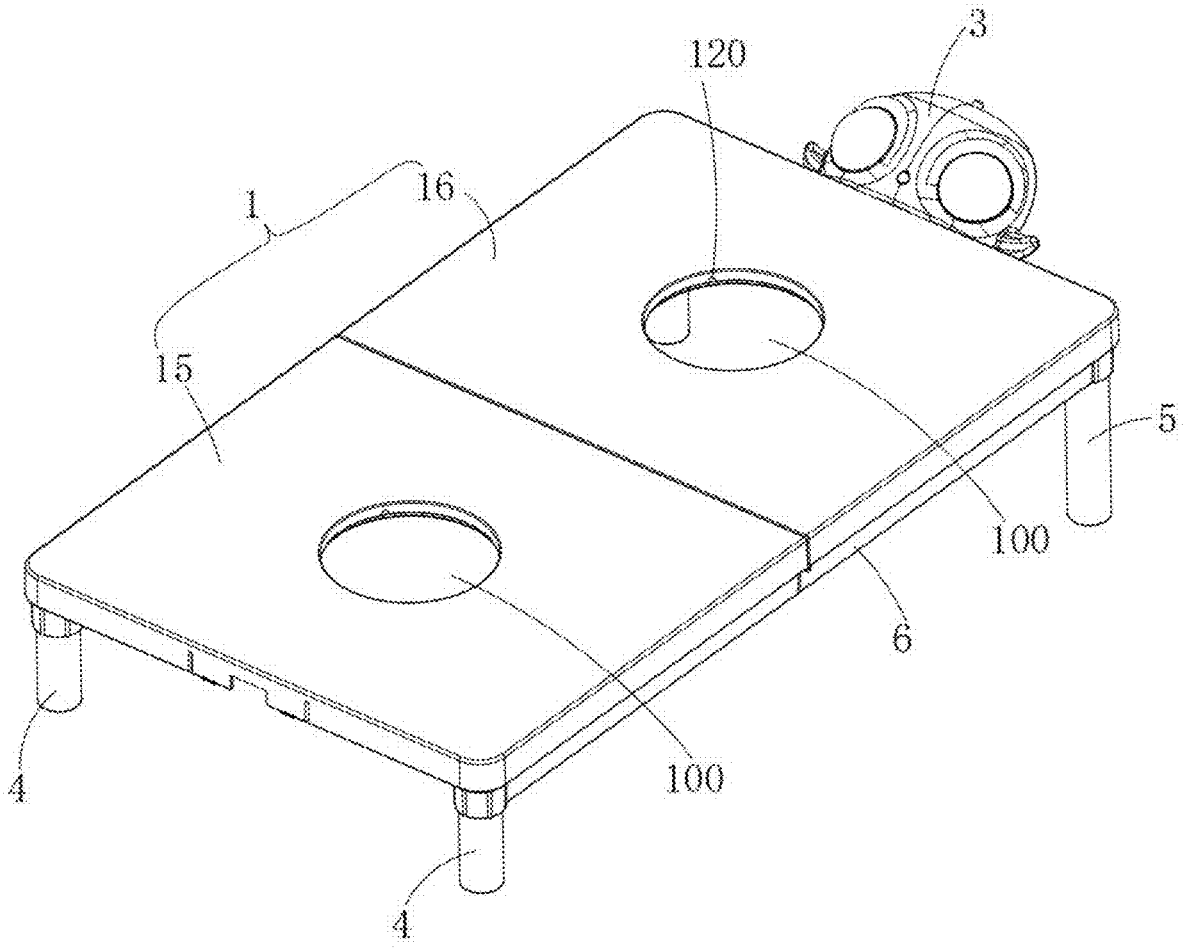
FIG. 1 is a first schematic view of an overall structure of a throwing object counting device according to an embodiment of the present disclosure.

1—panel; 100—receiving hole; 101—bottom face of panel; 11—plate body; 12—positioning edge; 13—side edge; 14—embedding groove; 15—first support plate; 16—second support plate; 1101—front side of plate body; 1102—rear side of plate body; 151—first plate body; 152—first limiting portion; 153—first rotating portion; 154—first snap portion; 161—second plate body; 162—second limiting portion; 163—second rotating portion; 164—second snap portion; 1541—first hook; 1542—first snap hole; 1641—second hook; 1642—second snap hole; 1500—through hole; 120—sensing opening;

2—sensing module; 21—receiving shell; 22—sensing unit; 210—receiving cavity; 211—wire channel;

3—counting module; 31—housing; 32—control board; 33—display unit; 34—timing unit; 35—battery; 36—switch; 311—housing body; 312—embedding protrusion; 331—score display area; 332—time display area; 3111—upper cover; 3112—bottom cover;

4—front support leg; 5—rear support leg;

6—reinforcing rod; 601—front end of reinforcing rod; 602—rear end of reinforcing rod; 61—first rod body; 62—second rod body;

d—wire.

DETAILED DESCRIPTION

The following describes some non-limiting exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure shall fall within the scope of the disclosure.

Unless otherwise defined, all technical and scientific terms used herein have the same meaning as commonly understood by those skilled in the art to which the present disclosure belongs. The terms used in the description of the present disclosure herein are intended for describing particular embodiments only and are not intended to limit the present disclosure. In the description, claims, and the above drawings of the present disclosure, the terms "including" and "having", as well as their variants, are intended to convey a non-exclusive inclusion. The terms "first", "second", etc., as used herein, are intended to distinguish between different objects, rather than to describe a particular order.

Reference to "embodiments" herein implies that a particular feature, structure, or characteristic described in conjunction with an embodiment may be included in at least one embodiment of the present disclosure. The appearance of the phrase at various places in the specification does not necessarily refer to the same embodiment, nor is it a separate or an alternative embodiment that is mutually exclusive of other embodiments. One skilled in the art would explicitly and implicitly understand that the embodiments described herein can be combined with other embodiments.

Referring to FIGS. 1 to 7, the present disclosure provides a throwing object counting device. The throwing object counting device may include a panel 1, a sensing module 2, and a counting module 3. The panel 1 may define a receiving hole 100 for a throwing object to pass through. The sensing module 2 may be mounted in or close to the receiving hole 100. The counting module 3 may be electrically connected to the sensing module 2. When a throwing object passes through the receiving hole 100, the sensing module 2 may send an electrical signal to the counting module 3, and the counting module 3 may provide a hit indication to the user based on this electrical signal.

During use, the panel 1 may be fixedly placed, for example, tilted and propped on a plane such as a tabletop or the ground. The user may pick up a throwing object and throw the throwing object, and when the throwing object passes through the receiving hole 100 on the panel 1, the sensing module 2 may correspondingly send an electrical signal to the counting module 3, which may then prompt the user that the thrown object may have hit the receiving hole 100. The form of the hit indication may be an audio prompt or a visual image prompt, such as a voice announcement of the number of hits/score, or using a display device to show the number of hits/score. At the same time, the counting module 3 may count the user's total throwing hit situation for the user.

Figure 2:
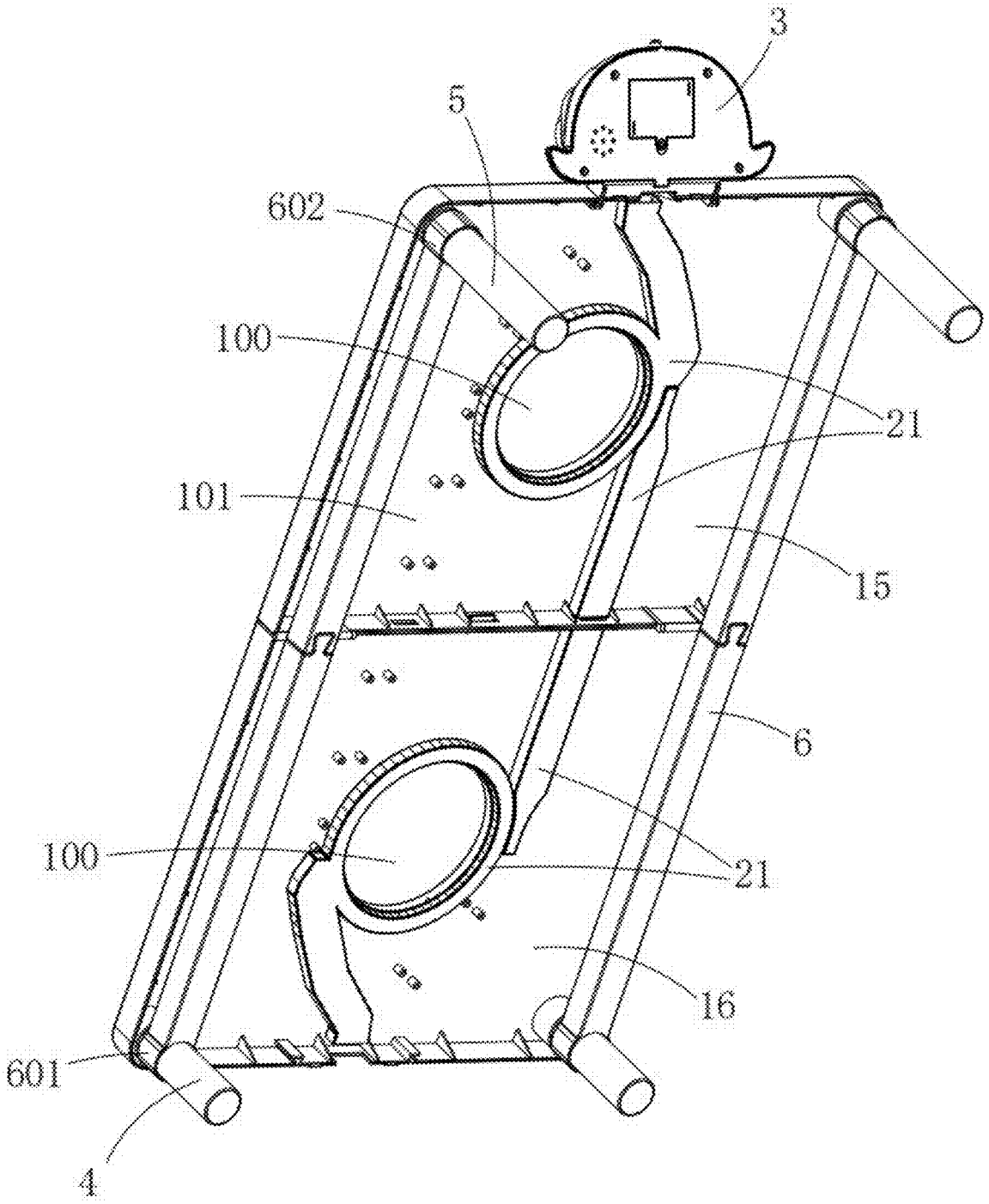
FIG. 2 is a second schematic view of the overall structure of the throwing object counting device according to an embodiment of the present disclosure.
Figure 3:
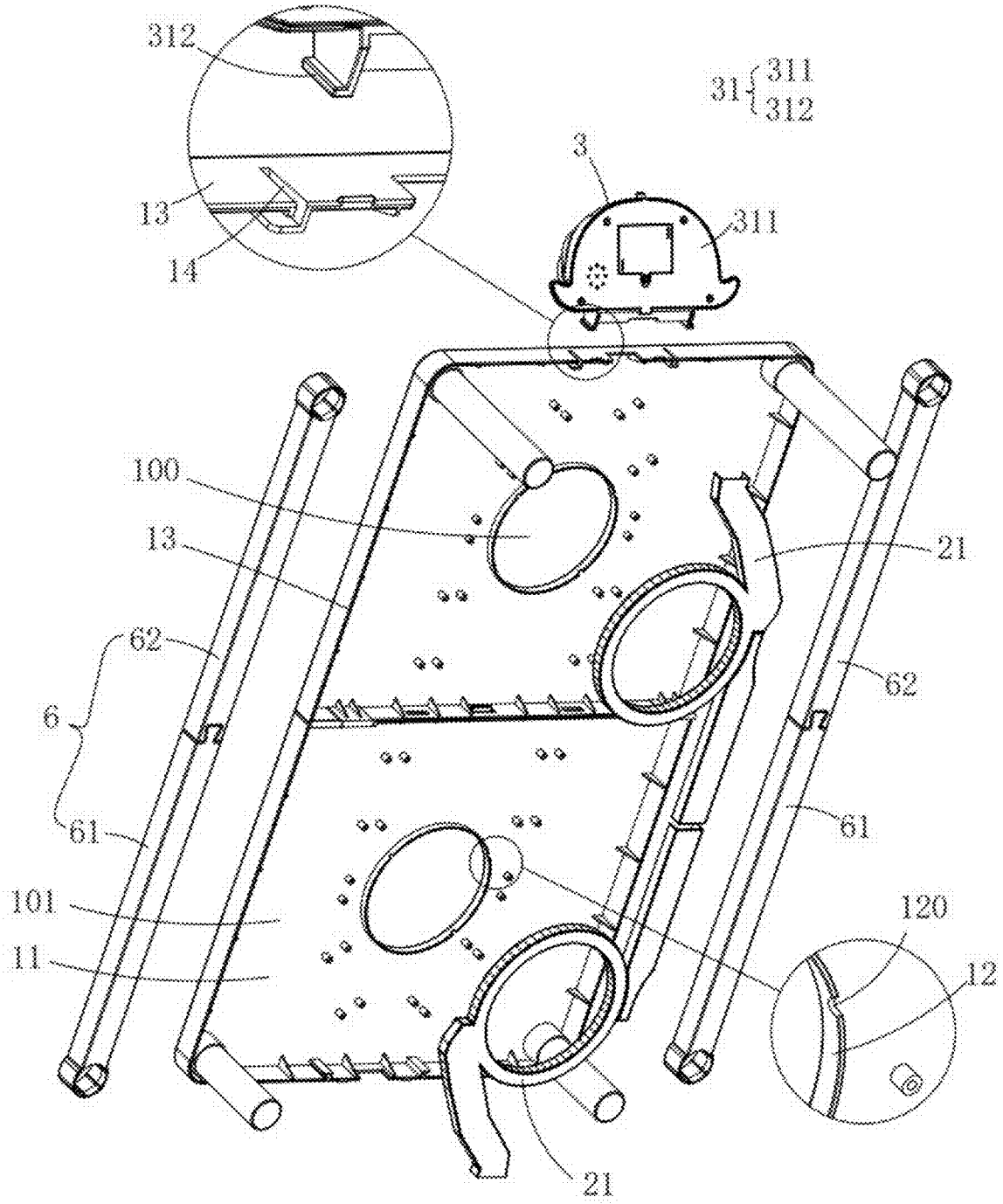
FIG. 3 is an exploded view of the throwing object counting device according to an embodiment of the present disclosure.
Figure 4:
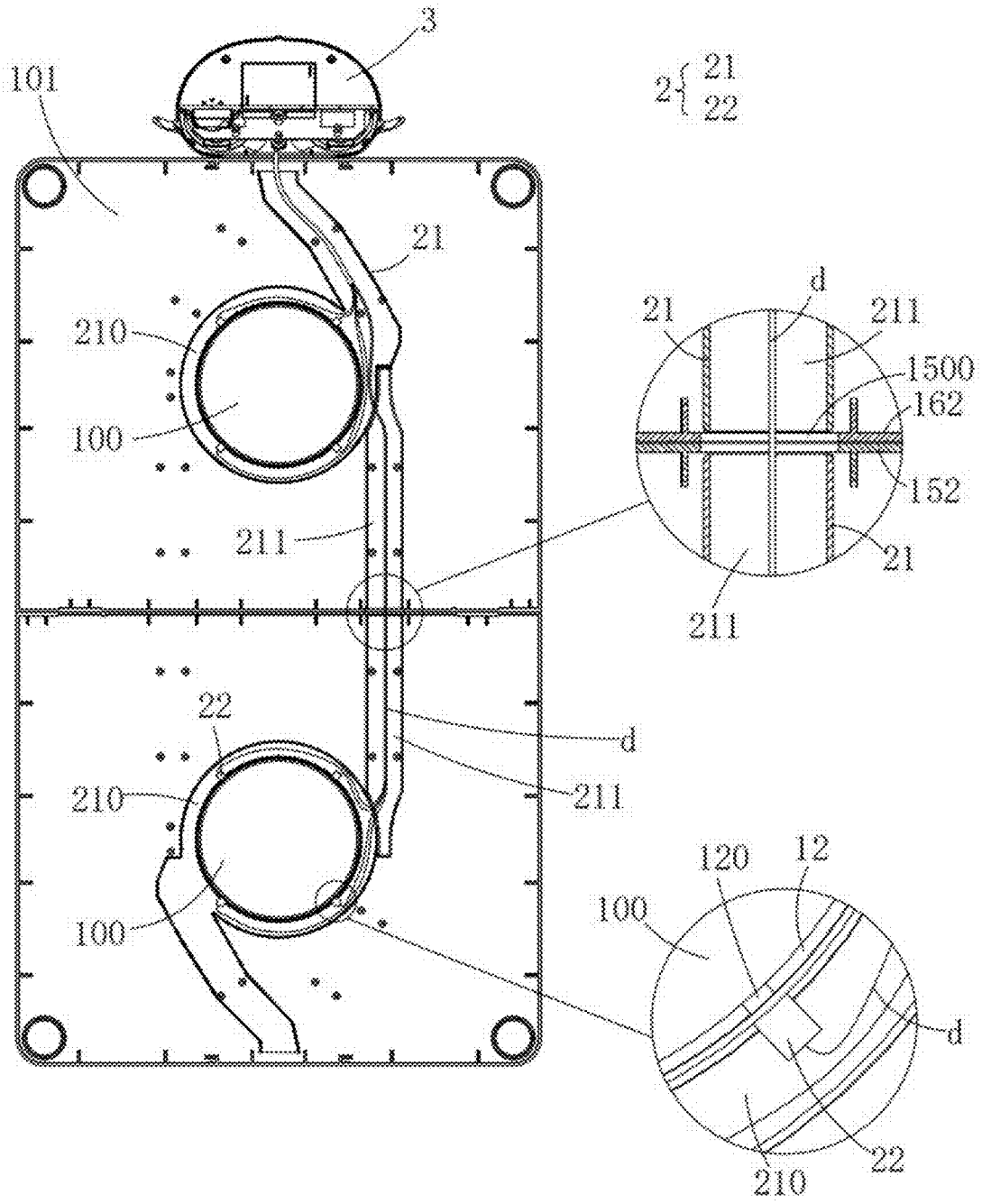
FIG. 4 is a schematic view of a receiving cavity and a wire channel according to an embodiment of the present disclosure.

Regarding the sensing module 2, in some embodiments, referring to FIGS. 2 to 4, the sensing module 2 may include a receiving shell 21 and at least one sensing unit 22. The receiving shell 21 may be fixedly mounted to a bottom face 101 of the panel 1 by screws, or the receiving shell 21 and the panel 1 may be integrally formed as a one-piece structure. A receiving cavity 210 may be formed between the receiving shell 21 and the panel 1, and the sensing unit 22 may be arranged in the receiving cavity 210. Furthermore, at least one sensing opening 120 may be formed on the receiving shell 21 or the panel 1, the receiving cavity 210 and the receiving hole 100 may be communicated with each other via the sensing opening 120, each sensing unit 22 may be arranged corresponding to one sensing opening 120, and the sensing unit 22 may identify and sense passage of a throwing object through the receiving hole 100 via the sensing opening 120.

Specifically, the sensing unit 22 may be in a form of an infrared sensing probe or a sensing spring plate. For example, in some embodiments, referring to FIG. 4, the sensing unit 22 may be in the form of the infrared sensing probe. The sensing module 2 may include four infrared sensing probes, and four sensing openings 120 may be correspondingly formed. The four sensing openings 120 may be distributed to surround the receiving hole 100 and equally spaced apart from each other. A sensing part of each infrared sensing probe may be exposed from the respective sensing opening 120, and the four infrared sensing probes may all point towards a center of the receiving hole 100. For example, in other embodiments (not shown in the figures), the sensing unit 22 may be a sensing spring plate. The sensing module 2 may include a plurality of sensing spring plates, and the sensing openings 120 may be provided corresponding to the number of sensing spring plates. Each of the plurality of sensing spring plates may extend out from a respective one of the sensing openings 120, and the plurality of sensing spring plates may cooperatively form a petal-like structure in the receiving hole 100. When a throwing object passes through the petal-like structure, the sensing spring plates may deform, correspondingly triggering the sensing spring plates.

In some embodiments, referring to FIGS. 3 and 4, the panel 1 may include a plate body 11 and a positioning edge 12. The receiving hole 100 may be formed on the plate body 11, the positioning edge 12 may be arranged to surround the receiving hole 100, and the sensing opening 120 may be formed on the positioning edge 12. The positioning edge 12 may limit a mounting position of the sensing unit 22 and the receiving shell 21, preventing a mounting position deviation.

To increase fun of competition, in some embodiments, referring to FIGS. 1 to 6, at least two receiving holes 100 may be opened on the panel 1. The number of sensing modules 2 may be at least two corresponding to the at least two receiving holes 100, and each sensing module 2 may be electrically connected to a same counting module 3. For example, two receiving holes 100 may have different heights, or may be at different distances from the user, or may have different aperture sizes, and correspondingly, throwing hit difficulties corresponding to the two receiving holes 100 may be also different from each other. The counting module 3 may correspondingly issue different prompts according to different electrical signals received from the sensing modules 2. For example, in some embodiments, each of the two receiving holes 100 may correspond to a respective one of two different scoring criteria, and the counting module 3 may have a counting multiplier corresponding to the electrical signal from one of the two sensing modules 2 different from a counting multiplier corresponding to the electrical signal from the other of the two sensing modules 2. For example, when the user hits a lower receiving hole 100 once, the counting module 3 may prompt a score of 20 points, and when the user hits a higher receiving hole 100 once, the counting module 3 may prompt a score of 40 points.

Each sensing module 2 may be connected to the same counting module 3, and the counting module 3 may count the user's total score. Specifically, a wire channel 211 may also be formed between the receiving shell 21 of each sensing module 2 and the bottom face 101 of the panel 1. The wire channel 211 may be communicated to the receiving cavity 210, and the wire channel 211 may extend towards the counting module 3. Each sensing unit 22 may be electrically connected to the counting module 3 via a wire d, and the wire d may pass through the wire channel 211. The wire channel 211 of each sensing module 2 may be communicated with each other, and the wire channel 211 closest to the counting module 3 may also extend to the counting module 3, to minimize an exposure of wires d and reduce safety risks.

Regarding the counting module 3, in some embodiments, visual images may be used to prompt the user. Specifically, referring to FIG. 3 and FIG. 7, the counting module 3 may include a housing 31, a control board 32, and a display unit 33. The housing 31 may be mounted on the panel 1, specifically, the housing 31 may be mounted at an edge of the panel 1 or on the bottom face 101 of the panel 1. The control board 32 and the display unit 33 may be mounted in the housing 31. Each of the sensing module 2 and the display unit 33 may be electrically connected to the control board 32. A part of the display unit 33 may be exposed from the housing 31, or a part of the housing 31 corresponding to the display unit 33 may be transparent. The display unit 33 may display numerical information for counting/scoring.

For example, in some embodiments, the housing 31 may be detachably mounted at the edge of the panel 1, which may be more convenient for storage and transportation. Specifically, the panel 1 may include a plate body 11 and a side edge 13 arranged to surround the plate body 11. An embedding groove 14 may be formed on the side edge 13 along a thickness direction of the plate body 11. The housing 31 may include a housing body 311 and an embedding protrusion 312 formed on a side of the housing body 311. The embedding protrusion 312 may be embedded in the embedding groove 14 in an interference fit manner. Each of the display unit 33 and the control board 32 may be mounted to the housing body 311. A shape of the housing body 311 may be arranged in various ways, for example, arranged as a cartoon shape of an animal's head, thereby increasing aesthetics of the throwing object counting device. Specifically, the housing body 311 may include an upper cover 3111 and a bottom cover 3112, and the upper cover 3111 and the bottom cover 3112 may be connected with each other by screws, thereby cooperatively forming the housing body 311 and a space for mounting the control board 32 and the display unit 33.

Figure 6:
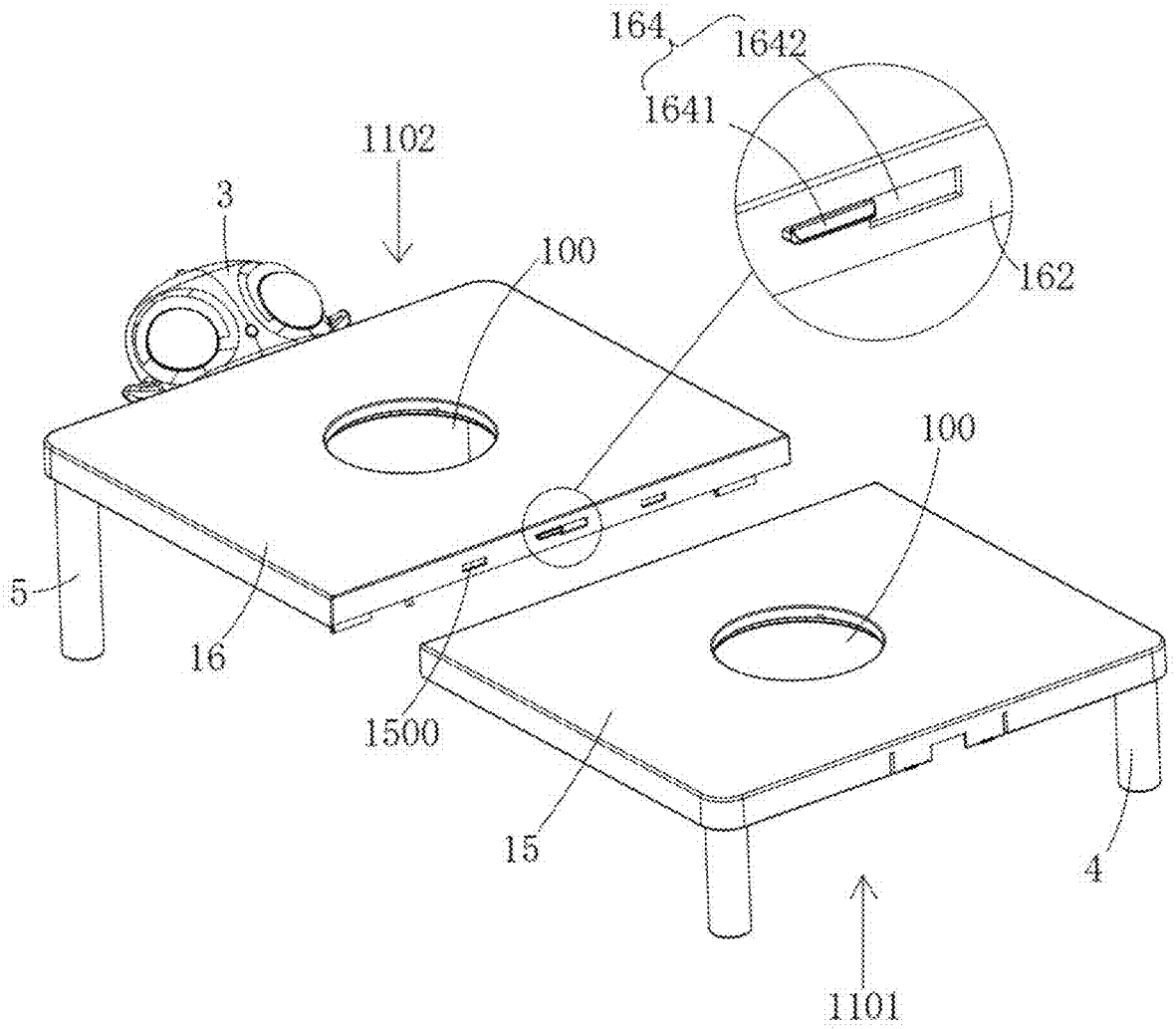
FIG. 6 is a second schematic view of the connection structure of the first support plate and the second support plate according to an embodiment of the present disclosure.

In some embodiments, referring to FIGS. 1 and 6, the throwing object counting device may further include a front support leg 4 and a rear support leg 5. The front support leg 4 may be arranged close to a front side 1101 of the plate body 11, and the rear support leg 5 may be arranged close to a rear side 1102 of the plate body 11. The rear support leg 5 may be longer than the front support leg 4, so that the rear side 1102 of the plate body 11 may be higher than the front side 1101 of the plate body 11. The embedding groove 14 may be located at the rear side 1102 of the plate body 11, so that the housing body 311 may be located above the plate body 11. Correspondingly, one receiving hole 100 may be formed close to the front side 1101 of the plate body 11, and one receiving hole 100 may be formed close to the rear side 1102 of the plate body 11, thereby forming two receiving holes 100 with different heights and distances from the user. The housing body 311 being located above the plate body 11 may make it easier for the user to view a numerical information displayed on the display unit 33.

In other embodiments (not shown in the figures), the housing 31 may also be fixedly mounted to the bottom face 101 of the panel 1, and a through window may be formed on an upper face of the panel 1, from which the display unit 33 may be exposed.

Figure 7:
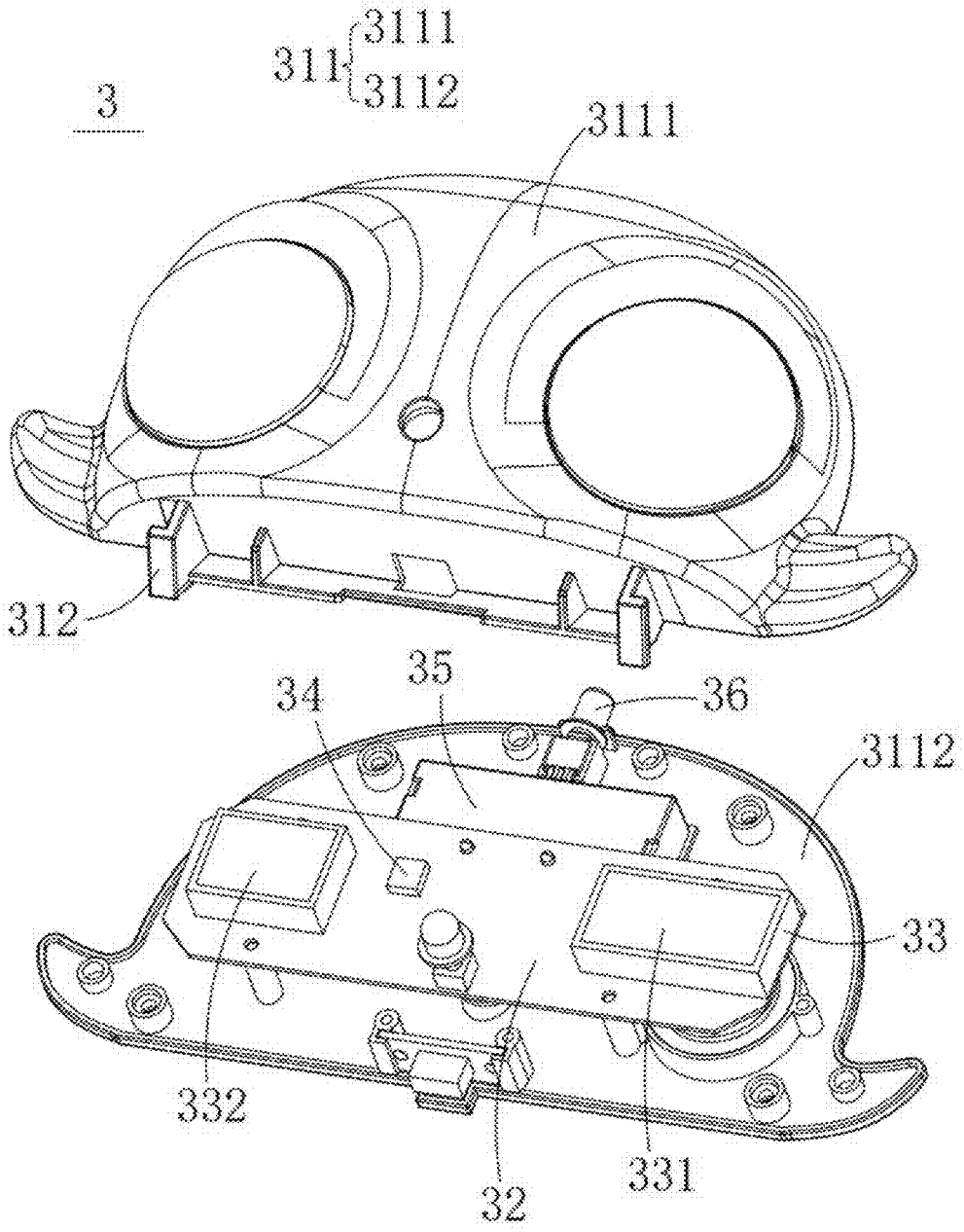
FIG. 7 is a structural view of a counting module according to an embodiment of the present disclosure.

To increase the fun of user throwing, in some embodiments, the counting module 3 may further include a timing unit 34. The timing unit 34 may be electrically connected to the control board 32. The display unit 33 may be arranged with a score display area 331 and a time display area 332. A user's total throwing hit score/total count numerical information may be displayed in the score display area 331, and a time information calculated by the timing unit 34 may be displayed in the time display area 332. Of course, two display units 33 may also be arranged to display the time information and the throwing hit score information respectively. As shown in FIG. 7, the housing body 311 may be in an animal head shape, and two "eyes" of the animal head may be transparent and correspond to the score display area 331 and the time display area 332 respectively.

Figure 5:
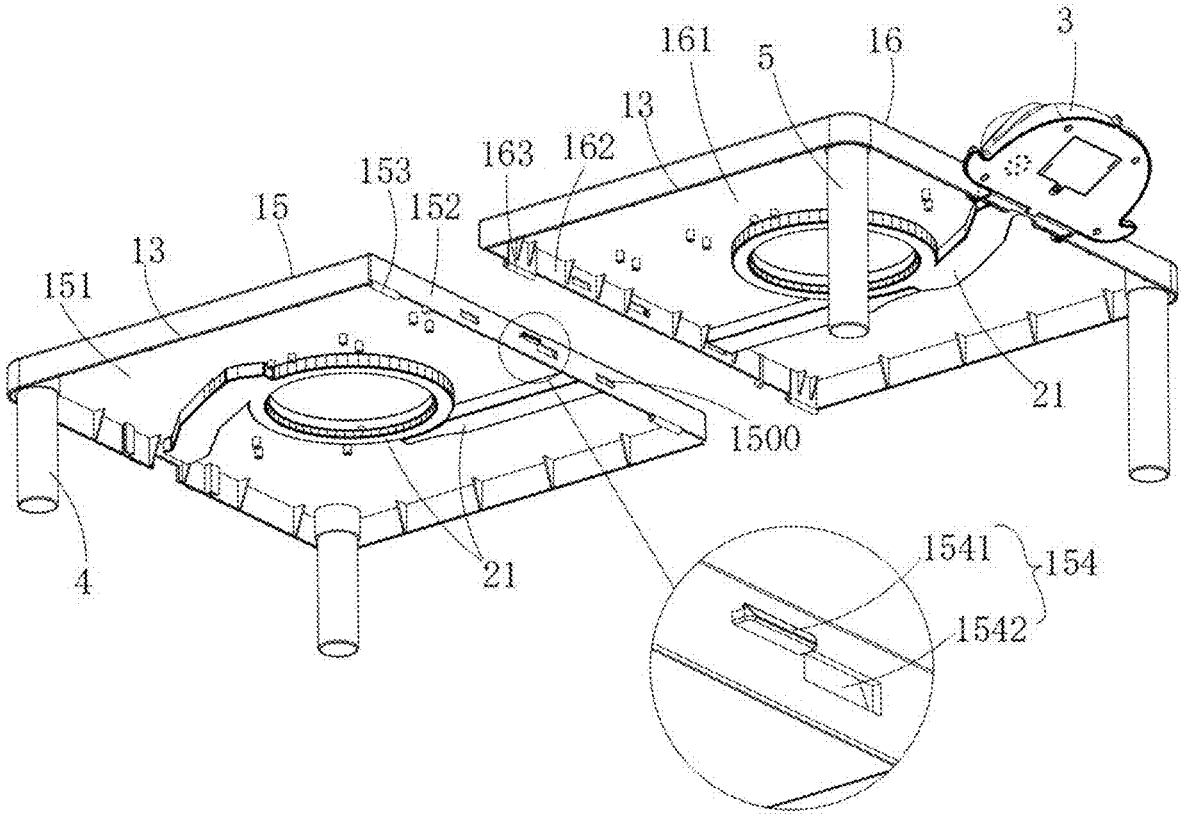
FIG. 5 is first schematic view of a connection structure of a first support plate and a second support plate according to an embodiment of the present disclosure.

To reduce packaging and transportation costs of the throwing object counting device and to facilitate storage, in some embodiments, referring to FIGS. 2, 5, and 6, the panel 1 may include a first support plate 15 and a second support plate 16. The front support leg 4 may be detachably mounted to the first support plate 15, and the rear support leg 5 may be detachably mounted to the second support plate 16. The first support plate 15 and the second support plate 16 may be detachably connected with each other or foldably connected with each other, so that the panel 1 may have a use state and a storage state. Specifically, when the first support plate 15 and the second support plate 16 are spliced with each other or unfolded relative to each other into a complete plate-like object, the panel 1 may be in the use state, and when the first support plate 15 and the second support plate 16 are separated from each other or folded relative to each other, the panel 1 may be in the storage state, reducing the length of the panel 1.

To prevent the first support plate 15 and the second support plate 16 from naturally being separated from each other when the panel 1 is in the use state, in some embodiments, the first support plate 15 may include a first plate body 151, a first limiting portion 152 formed on a side of the first plate body 151, a first rotating portion 153, and a first snap portion 154. The second support plate 16 may include a second plate body 161, a second limiting portion 162 formed on a side of the second plate body 161, a second rotating portion 163, and a second snap portion 164. The first rotating portion 153 may be rotatably connected to the second rotating portion 163, so that the first plate body 151 and the second plate body 161 may be folded towards each other or unfolded relative to each other.

Specifically, when the first plate body 151 and the second plate body 161 are unfolded to be flush with each other, the first limiting portion 152 and the second limiting portion 162 may abut against each other, simultaneously causing the first snap portion 154 and the second snap portion 164 to be elastically snap-fitted to each other, to prevent the first plate body 151 and the second plate body 161 from continuing to move relative to each other, thereby fixing the panel 1 in the use state. Conversely, the user may apply an external force to enable the first snap portion 154 and the second snap portion 164 to be separated from each other, and then drive the first plate body 151 and the second plate body 161 to fold relative to each other, to return the panel 1 to the storage state.

Each of the first plate body 151 and the second plate body 161 may define one receiving hole 100 and may be arranged with one sensing module 2. Each of the first limiting portion 152 and the second limiting portion 162 may define a through hole 1500. When the panel 1 is in the use state, the wire channels 211 of the two sensing modules 2 may be communicated with each other through the through hole 1500 of the first limiting portion 152 and the through hole 1500 of the second limiting portion 162, as shown in FIG. 4.

Regarding elastic snap structures of the first snap portion 154 and the second snap portion 164, specifically, referring to FIGS. 5 and 6, the first snap portion 154 may include a first hook 1541 arranged on the first limiting portion 152 and a first snap hole 1542 formed on the first limiting portion 152, the second snap portion 164 may include a second hook 1641 arranged on the second limiting portion 162 and a second snap hole 1642 formed on the second limiting portion 162. When the first limiting portion 152 and the second limiting portion 162 abut against each other, the first hook 1541 may be elastically snapped in the second snap hole 1642, and the second hook 1641 may be elastically snapped in the first snap hole 1542. The double snap structure may make the connection of the first snap portion 154 and the second snap portion 164 more stable.

In addition, the first limiting portion 152, the first plate body 151, and the side edge 13 connected to the first plate body 151 may be integrally formed as a one-piece structure, and the second limiting portion 162, the second plate body 161, and the side edge 13 connected to the second plate body 161 may be integrally formed as a one-piece structure.

To further improve the stability of the connection between the first support plate 15 and the second support plate 16 and prevent collapse at a joint between the first plate body 151 and the second plate body 161, in some embodiments, referring to FIGS. 1 to 3, the throwing object counting device may further include a reinforcing rod 6. A front end 601 of the reinforcing rod 6 may sleeve an outer periphery of the front support leg 4, and a rear end 602 of the reinforcing rod 6 may sleeve an outer periphery of the rear support leg 5, and the reinforcing rod 6 may abut against the first support plate 15 and/or the second support plate 16, to stabilize a relative position of the first plate body 151 and the second plate body 161.

Also for the purpose of saving packaging and transportation costs and facilitating storage, in some embodiments, the reinforcing rod 6 may include a first rod body 61 and a second rod body 62. The first rod body 61 may be connected to the front support leg 4, and the second rod body 62 may be connected to the rear support leg 5, so that the first rod body 61 and the second rod body 62 may be detachably connected with each other, specifically, the first rod body 61 and the second rod body 62 may be mutually embedded with each other in an interference fit manner. When the first rod body 61 and the second rod body 62 are separated from each other, a total length of the reinforcing rod 6 may be reduced, saving packaging and transportation costs, and facilitating storage.

In addition, the counting module also may include a battery 35 and a switch 36. The battery 35 may be mounted in the housing 31, and the switch 36 may be used to establish or break an electrical connection between the battery 35 and the control board 32.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The invention claimed is:

1. A throwing object counting device, comprising:

a panel, defining at least one receiving hole for a throwing object to pass through;

at least one sensing module, mounted in or adjacent to the periphery of the at least one receiving hole; and a counting module, electrically connected to the sensing module;

wherein the counting module comprises a housing, a control board, and a display unit, the housing is detachably mounted at edge of the panel, the control board and the display unit are mounted to the housing; a part of the display unit is exposed from the housing, or a part of the housing corresponding to the display unit is transparent; each of the sensing module and the display unit is electrically connected to the control board;

wherein the panel comprises a plate body and a side edge arranged to surround the plate body, and an embedding groove is formed on the side edge along a thickness direction of the plate body; the housing comprises a housing body and an embedding protrusion formed on a side of the housing body, the embedding protrusion is configured to be embedded in the embedding groove, and the display unit is mounted to the housing body.

2. The throwing object counting device according to claim 1, wherein the at least one sensing module comprises a receiving shell and at least one sensing unit, the receiving shell is mounted to a bottom face of the panel, and a receiving cavity is formed between the receiving shell and the panel;

at least one sensing opening is formed on the receiving shell or the panel, and the receiving cavity and the at least one receiving hole are communicated with each other via the at least one sensing opening;

the at least one sensing unit is mounted in the receiving cavity, and the at least one sensing unit is arranged corresponding to the at least one sensing opening.

3. The throwing object counting device according to claim 2, wherein the sensing unit is an infrared sensing probe or a sensing spring plate.

4. The throwing object counting device according to claim 2, wherein the panel comprises a plate body and a positioning edge, the at least one receiving hole is formed on the plate body, the positioning edge is arranged to surround the at least one receiving hole, and the at least one sensing opening is formed on the positioning edge.

5. The throwing object counting device according to claim 1, wherein the number of the at least one receiving hole is at least two, the number of the at least one sensing module is at least two, and each of the at least two sensing modules is electrically connected to the counting module.

6. The throwing object counting device according to claim 5, wherein a height of one of the at least two receiving holes is different from a height of another of the at least two receiving holes, and a counting multiplier of the counting module corresponding to one of the at least two sensing modules is different from a counting multiplier of the counting module corresponding to another of the at least two sensing modules.

7. The throwing object counting device according to claim 5, wherein each of the at least two sensing modules comprises a receiving shell and at least one sensing unit, the receiving shell is mounted to a bottom face of the panel, a receiving cavity is formed between the receiving shell and the panel, at least one sensing opening is formed on the receiving shell or the panel, the receiving cavity and the at least one receiving hole are communicated with each other via the at least one sensing opening, the at least one sensing unit is mounted in the receiving cavity, and the at least one sensing unit is arranged corresponding to the at least one sensing opening.

8. The throwing object counting device according to claim 7, wherein a wire channel is formed between the receiving shell and the bottom face of the panel, the wire channel is communicated with the receiving cavity, and the wire channel extends towards the counting module, the at least one sensing unit is electrically connected to the counting module via a wire, and the wire passes through the wire channel;

the wire channel of one of the at least two sensing modules is communicated with the wire channel of another of the at least two sensing modules.

9. The throwing object counting device according to claim 1, further comprising a front support leg and a rear support leg, the front support leg is arranged close to a front side of the plate body, the rear support leg is arranged close to a rear side of the plate body, and the rear support leg is longer than the front support leg such that the rear side of the plate body is higher than the front side of the plate body;

the embedding groove is formed at the rear side of the plate body, such that the housing body is arranged above the plate body.

10. The throwing object counting device according to claim 1, wherein the counting module further comprises a timing unit, the timing unit is electrically connected to the control board, and the display unit is arranged with a score display area and a time display area.

11. A throwing object counting device, comprising:

a panel, defining at least one receiving hole for a throwing object to pass through;

at least one sensing module, mounted in or adjacent to the periphery of the at least one receiving hole; and a counting module, electrically connected to the sensing module;

wherein the panel comprises a first support plate and a second support plate, the first support plate and the second support plate are detachably connected with each other or foldably connected with each other, such that the panel has a use state and a storage state;

wherein the first support plate comprises a first plate body, a first limiting portion formed on a side of the first plate body, a first rotating portion, and a first snap portion;

the second support plate comprises a second plate body, a second limiting portion formed on a side of the second plate body, a second rotating portion, and a second snap portion;

the first rotating portion is rotatably connected to the second rotating portion, enabling the first plate body and the second plate body to be folded relative to each other or unfolded relative to each other; when the first limiting portion and the second limiting portion abut against each other, the first plate body and the second plate body are unfolded to be flush with each other, and the first snap portion and the second snap portion are elastically snap-fitted to each other, enabling the panel to be in the use state.

12. The throwing object counting device according to claim 11, wherein the first snap portion comprises a first hook arranged on the first limiting portion and a first snap hole formed on the first limiting portion, and the second snap portion comprises a second hook arranged on the second limiting portion and a second snap hole formed on the second limiting portion;

when the first limiting portion and the second limiting portion abut against each other, the first hook is elastically snapped in the second snap hole, and the second hook is elastically snapped in the first snap hole.

13. The throwing object counting device according to claim 1, further comprising a front support leg and a rear support leg, the front support leg is arranged adjacent to a front side of the panel, the rear support leg is arranged close to a rear side of the panel, the rear support leg is longer than the front support leg, so that the rear side of the panel is higher than the front side of the panel.

14. The throwing object counting device according to claim 13, wherein the panel comprises a first support plate and a second support plate, the first support plate and the second support plate are detachably connected with each other or foldably connected with each other, such that the panel has a use state and a storage state;

the front support leg is detachably mounted to the first support plate, and the rear support leg is detachably mounted to the second support plate.

15. The throwing object counting device according to claim 14, further comprising a reinforcing rod, wherein the reinforcing rod comprises a front end and a rear end, the front end of the reinforcing rod sleeves an outer periphery of the front support leg, the rear end of the reinforcing rod sleeves an outer periphery of the rear support leg, and the reinforcing rod abuts against at least one of the first support plate and the second support plate.

16. The throwing object counting device according to claim 15, wherein the reinforcing rod comprises a first rod body and a second rod body, the first rod body is connected to the front support leg, the second rod body is connected to the rear support leg, and the first rod body and the second rod body are detachably connected with each other.

* * * * *